US008939351B2

(12) United States Patent
Goudreau et al.

(10) Patent No.: US 8,939,351 B2
(45) Date of Patent: Jan. 27, 2015

(54) BAG-IN-BOX CONTAINER AND METHOD OF CONSTRUCTING THE SAME

(75) Inventors: Rodney Allen Goudreau, Warren, MA (US); Gayle Katherine Martinez, Worcester, MA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 1634 days.

(21) Appl. No.: 11/874,669

(22) Filed: Oct. 18, 2007

(65) Prior Publication Data

US 2009/0101699 A1 Apr. 23, 2009

(51) Int. Cl.
*B65D 5/56* (2006.01)
*B65D 77/06* (2006.01)

(52) U.S. Cl.
CPC ..... *B65D 77/065* (2013.01)
USPC ..... 229/117.3; 229/117.27; 222/105

(58) Field of Classification Search
USPC ..... 229/117.27, 117.3, 117.14, 117.35, 229/223; 222/105
See application file for complete search history.

(56) References Cited

U.S. PATENT DOCUMENTS

| | | | | |
|---|---|---|---|---|
| 1,522,311 | A * | 1/1925 | Maclellan | 229/108 |
| 3,123,254 | A * | 3/1964 | Rabby et al. | 222/105 |
| 4,572,422 | A | 2/1986 | Heuberger et al. | |
| 5,377,876 | A | 1/1995 | Smernoff | |
| 5,715,992 | A | 2/1998 | Andrews, Sr. et al. | |
| 5,909,841 | A | 6/1999 | Andrews, Sr. et al. | |
| 6,053,401 | A | 4/2000 | Andrews, Sr. | |
| 6,196,452 | B1 | 3/2001 | Andrews, Sr. et al. | |
| 6,209,781 | B1 | 4/2001 | Sylvester et al. | |
| 6,253,993 | B1 | 7/2001 | Lloyd et al. | |
| 6,290,124 | B2 | 9/2001 | Andrews, Sr. et al. | |
| 6,454,134 | B1 | 9/2002 | Aujesky et al. | |
| RE38,377 | E * | 1/2004 | Geshay | 222/105 |
| 6,736,289 | B2 | 5/2004 | Cook et al. | |
| 6,755,324 | B2 | 6/2004 | Geshay | |
| 6,877,654 | B2 | 4/2005 | Bartlett et al. | |
| 6,971,550 | B2 | 12/2005 | Kuge et al. | |
| 7,007,825 | B2 | 3/2006 | Crosland et al. | |
| 7,077,309 | B2 * | 7/2006 | Andrews, Sr. | 229/117.15 |
| 7,150,377 | B2 | 12/2006 | Cook et al. | |
| 2002/0047040 | A1 | 4/2002 | Andrews, Sr. et al. | |
| 2003/0134059 | A1 | 7/2003 | Andrews, Sr. et al. | |
| 2005/0051573 | A1 | 3/2005 | Crosland et al. | |
| 2006/0011715 | A1 | 1/2006 | Bartlett et al. | |
| 2006/0071021 | A1 | 4/2006 | Steeves et al. | |
| 2006/0097005 | A1 | 5/2006 | Hill et al. | |
| 2006/0202005 | A1 | 9/2006 | Andrews, Sr. et al. | |

* cited by examiner

*Primary Examiner* — Christopher Demeree
(74) *Attorney, Agent, or Firm* — Armstrong Teasdale LLP

(57) ABSTRACT

A bag-in-box container for storing and dispensing liquids is provided. The container includes an outer box including two opposing end walls, two opposing side walls, a bottom wall, a top wall, a fill opening, and a dispensing opening. The container further includes an inner, liquid-impermeable bag stored within the outer box. The bag includes a first opening, a filling fixture coupled to the first opening, a second opening, and a dispensing fixture coupled to the second opening. The filling fixture extends through the fill opening and defines a first fluid passageway extending from outside of the box to an internal cavity of the bag. The dispensing fixture extends through the dispensing opening and defines a second fluid passageway extending from the bag internal cavity to outside of the box.

21 Claims, 7 Drawing Sheets

BAG-IN-BOX CONTAINER AND METHOD OF CONSTRUCTING THE SAME

BACKGROUND OF THE INVENTION

This invention relates generally to a container that includes a flexible bag stored within the container, and more particularly to a container having a first opening for filling a flexible bag stored within the container with a liquid, and a second opening for dispensing the liquid from the flexible bag.

Containers fabricated from cardboard, paperboard, corrugated paperboard and the like have been used in combination with liquid holding bags for several years. In particular, these bag-in-box containers have proved to be durable, convenient, and cost-effective for use in storing, transporting, and dispensing various liquids and beverages, such as wine, soft drinks, and coffee. Many of these containers have a concealed inner region for housing a liquid holding bag, a pouring spout, and a handle for carrying.

For example, Andrews, Sr. et al., U.S. Pat. No. 5,715,992 ('992), discloses a paperboard beverage container particularly suited for carrying and dispensing multiple cups of coffee. In particular, the '992 beverage container consists of an outer shell with two pairs of opposing side walls, an opening in one of the side walls, a bag within the outer shell, and a mouth attached to the bag. The mouth is positioned in the opening to allow fluid to be transferred from the bag to a receptacle, such as a cup or mug. In addition, the mouth is used for filling the bag within the outer shell. The beverage container further consists of a series of upper end flaps forming a top and a handle, and a series of lower end flaps forming a bottom. The bottom is preferably recessed to avoid contact of hot coffee contained in the bag with a supporting surface, such as furniture.

However, in certain industries and businesses which employ containers fabricated from cardboard, paperboard, corrugated paperboard and the like, such as the fast food industry, the catering industry, the retail coffee industry, etc., it is often important that the containers be configured for articulation into their "use" configurations in an efficient, reliable and rapid manner.

Moreover, these containers are oftentimes filled in a variety of ways and from a variety of dispensers. In at least some known cases, these containers are filled will hot coffee wherein the coffee is poured directly into the bag-in-box containers from a spigot on an urn type dispenser or directly from a coffee pot. In both cases, the mouth of the bag-in-box container must be positioned directly under the spigot or the pour spout of the coffee pot. In the case of the urn type dispenser, the positioning of the mouth of the container beneath the urn spigot can be difficult due to space limitations such that the container must be tilted or held in a position that makes the transfer of hot liquid dangerous. Additionally, in at least some cases, a funnel or other transfer device is needed to transfer liquid from a coffee pot to the bag-in-box container. In these know cases, the bag-in-box container described in the '992 patent does not address the space limitations of filling the container from an urn type of dispenser or directly from a coffee pot.

A bag-in-box container that addresses the space limitations of a variety of urn type dispensers such that the bag-in box can be more easily and safely filled with hot liquids is needed. Moreover, a bag-in-box container that can be easily and safely filled with hot liquids directly from a coffee pot or other pitcher type dispenser without the use of additional devices such as a funnel is also needed.

BRIEF DESCRIPTION OF THE INVENTION

In one aspect, a bag-in-box container for storing and dispensing liquids is provided. The container includes an outer box including two opposing end walls, two opposing side walls, a bottom wall, a top wall, a fill opening, and a dispensing opening. The container further includes an inner, liquid-impermeable bag stored within the outer box. The bag includes a first opening, a filling fixture coupled to the first opening, a second opening, and a dispensing fixture coupled to the second opening. The filling fixture extends through the fill opening and defines a first fluid passageway extending from outside of the box to an internal cavity of the bag. The dispensing fixture extends through the dispensing opening and defines a second fluid passageway extending from the bag internal cavity to outside of the box.

In another aspect, a bag-in-box container for storing and dispensing liquids is provided. The container includes an outer box including two opposing end panels, two opposing side panels, a bottom panel, a top panel, a fill opening, and a dispensing opening. The container further includes an inner, liquid-impermeable bag stored within the outer box. The bag includes a first opening, a filling fixture coupled to the first opening, a second opening, and a dispensing fixture coupled to the second opening. The fill opening is configured to receive the filling fixture. The dispensing opening is configured to receive the dispensing fixture. The filling fixture defines a first fluid passageway and is sized and shaped such that a liquid can be poured through the filling fixture from a source having an outlet spaced above the filling fixture. The dispensing fixture defines a second fluid passageway and is sized and shaped such that the liquid can be poured through the dispensing fixture into a receptacle.

In a further aspect, a method of constructing a bag-in-box container for storing and dispensing liquids is provided. The method includes forming an outer box including two opposing end walls, two opposing side walls, a bottom wall, a top wall, a fill opening, and a dispensing opening. The method further includes coupling an inner, liquid-impermeable bag within the outer box to store the bag within the outer box. The bag includes a first opening, a filling fixture coupled to the first opening, a second opening, and a dispensing fixture coupled to the second opening. The filling fixture extends extending through the fill opening and defines a first fluid passageway extending from outside of the box to an internal cavity of the bag, and the dispensing fixture extends through the dispensing opening and defines a second fluid passageway extending from the bag internal cavity to the outside of the box.

DETAILED DESCRIPTION OF THE INVENTION

The present invention provides a container that includes a flexible, liquid-impermeable bag that is received within the container, and a method of constructing the same. The container includes a first opening for filling the bag included within the container with a liquid, and a second opening for dispensing the liquid from the bag. In one embodiment, the container is fabricated from a paperboard material. The container, however, may be fabricated using any suitable material, and therefore is not limited to a specific type of material. In alternative embodiments, the container is fabricated using cardboard, plastic and/or any suitable material known to those skilled in the art and guided by the teachings herein provided. Moreover, the container may have any suitable size, shape and/or configuration.

In one embodiment, the container includes a marking thereon including, without limitation, indicia that communicates the product, a manufacturer of the product and/or seller of the product. For example, the marking may include printed text that indicates a product's name and briefly describes the product, logos and/or trademarks that indicate a manufacturer and/or seller of the product, and/or designs and/or ornamentation that attract attention.

Figure 1:
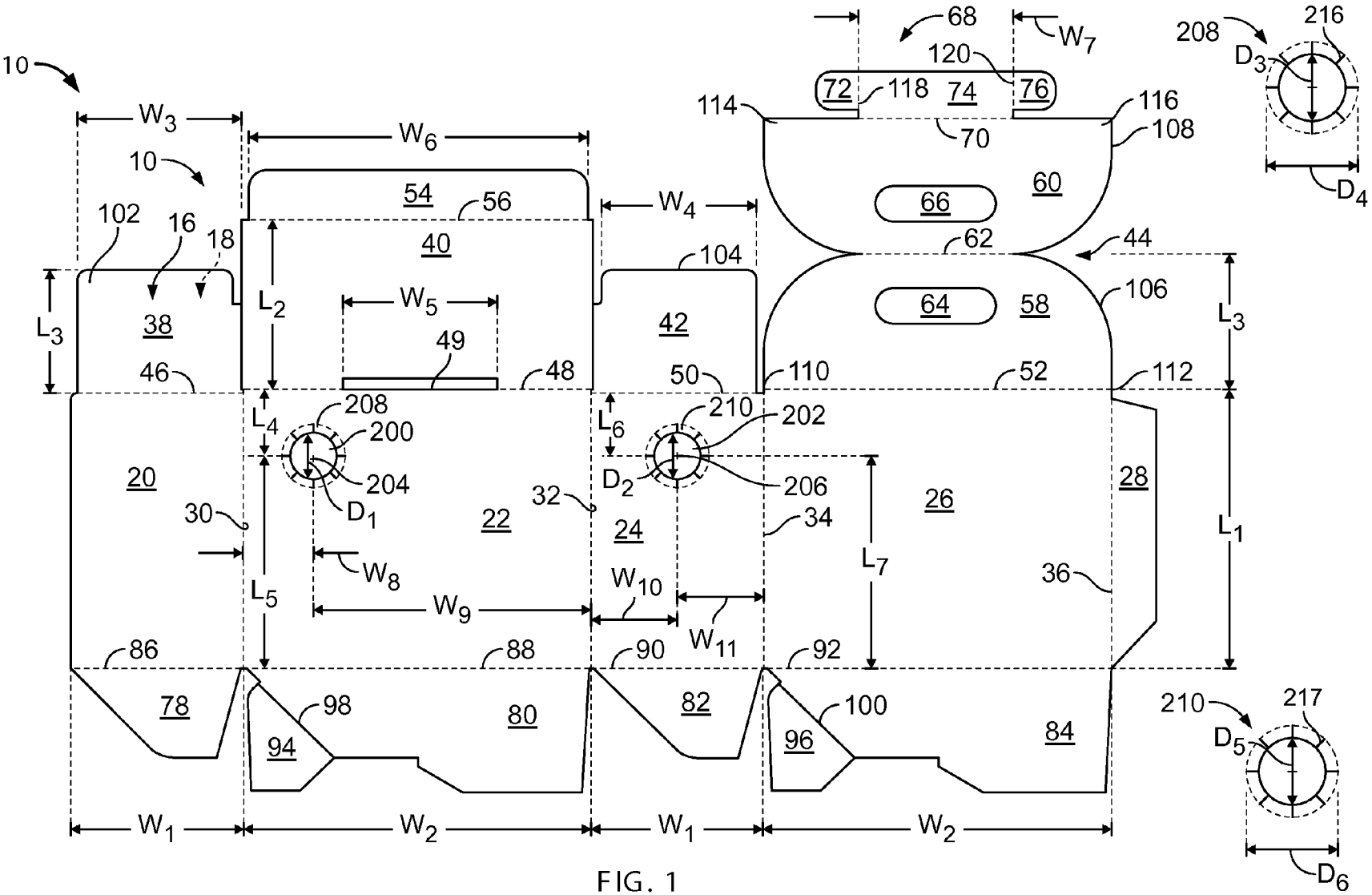
FIG. 1 is a top plan view of a blank of sheet material for constructing a container according to one embodiment.

FIG. 1 is a top plan view of an exemplary embodiment of a blank of sheet material. The blank of sheet material for forming an outer box 250 is designated in its entirety by the reference numeral 10. Outer box 250 is configured to receive a bag 230. Box 250 and bag 230 form a bag-in-box container 300. Although the blank may include any suitable material without departing from the scope of the present invention, in one embodiment the blank includes cardboard, corrugated board, and/or plastic. Blank 10 includes an interior surface 16 and an opposing exterior surface 18. In the exemplary embodiment, blank 10 includes indicia on exterior surface 18. Alternatively, blank 10 includes indicia on interior surface 16.

Blank 10 further includes a plurality of adjacent substantially rectangular panels 20, 22, 24, 26, 28 that are connected together by a plurality of preformed, generally parallel, fold lines 30, 32, 34, 36, respectively. Specifically, the adjacent panels include a first end panel 20, a first side panel 22, a second end panel 24, a second side panel 26, and a glue panel 28. The first side panel 22 extends from the first end panel 20 along fold line 30, the second end panel 24 extends from the first side panel 22 along fold line 32, the second side panel 26 extends from the second end panel 24 along fold line 34, and the glue panel 28 extends from the second side panel 26 along fold line 36. In an alternative embodiment, the blank may have any number of aligned panels wherein each panel has any suitable shape and/or size that enables container 300 to function as described herein.

Moreover, each panel 20, 22, 24, 26 includes a top panel 38, 40, 42, 44 extending therefrom along a preformed fold line 46, 48, 50, 52, respectively. In the exemplary embodiment, a slot 49 is defined within panel 40 and extends along a portion of fold line 48. In the exemplary embodiment, top panel 40 includes a closure flap 54 extending therefrom along a preformed fold line 56, and top panel 44 includes a first flap 58 and a second flap 60. First flap 58 extends from second side panel 26 along preformed fold line 52, and second flap 60 extends from first flap 58 along a preformed fold line 62. In the exemplary embodiment, first flap 58 includes a handle opening 64, and second flap 60 includes a handle opening 66. A handle flap 68 extends from second flap 60 along a preformed fold line 70. In the exemplary embodiment, handle flap 68 includes a first portion 72, a second portion 74, and a third portion 76. Handle flap 68 is configured to be inserted into slot 49 wherein first and second portions 72, 76 are configured to engage a portion of panel 40 when container 300 is constructed.

Also, in the exemplary embodiment, each panel 20, 22, 24, 26 includes a bottom panel 78, 80, 82, 84 extending therefrom along a preformed fold line 86, 88, 90, 92, respectively. In the exemplary embodiment, each bottom panel 80 and 84 include a bottom flap 94 and 96, respectively, extending therefrom along a preformed fold line 98 and 100, respectively.

In the exemplary embodiment, each panel of blank 10 has a size and shape for ease of assembly. Panels 20, 22, 24, 26 each have a length $L_1$. Panels 20, 24 have a width $W_1$, and panels 22, 26 have a width $W_2$ that is greater than width $W_1$. Moreover, each panel 40, 44 has width $W_2$, and each panel 38, 42 has width $W_3$. Panel 40 has a length $L_2$ that is less than length $L_1$. Each panel 38, 42 has a length $L_3$ that is less than length $L_2$. Each panel 38, 42 also has an upper edge 102, 104, respectively, distal from fold lines 46, 50. In the exemplary embodiment, edges 102, 104 are substantially parallel with fold lines 46, 50. Each distal end of panels 38, 42 has a width $W_4$ that is less than width $W_3$ to prevent each distal end from interfering with slot 49 when assembling container 300. Slot 49 has a width $W_5$ that is less than width $W_2$. In an alternative embodiment, slot 49 has any width that enables blank 10 to be assembled as described herein. Moreover, flap 54 has a width $W_6$ that is less than width $W_2$ of panels 22, 40 to ease assembly.

Each flap 58 and 60 of panel 44 is at least partially defined by an arcuate edge 106, 108, respectively, extending from respective fold lines 52, 70. Specifically, edge 106 extends between a first end 110 and a second end 112 of fold line 52, and edge 108 extends between a first end 114 and a second end 116 of fold line 70. In the exemplary embodiment, a portion of edges 106 and 108 overlap forming fold line 62 between flaps 58 and 60.

Handle flap 68 is insertable into slot 49. Second portion 74 of handle flap 68 is substantially rectangular and has a width $W_7$ that is less than width $W_5$ of slot 49. First and third portions 72 and 76 extend from second portion 74. Each first and third portions 72 and 76 has a substantially arcuate shape, and have a combined width that is less than width $W_7$. When container 300 is assembled, first and third portions 72 and 76 engage a portion of panel 40.

In the exemplary embodiment, panels 78, 80, 82, 84 and flaps 94, 96 are shaped to engage one another and form the bottom of container 300. Specifically, in the exemplary embodiment, each panel 78, 82 and flap 94, 96 has a substantially triangular shape, and panels 80, 84 have a polygonal shape.

In an alternative embodiment, panels and flaps of blank 10 have any suitable shape and/or size that enables container 300 to be assembled and function as described herein.

Blank 10 includes a fill opening or an ingress 200, and a dispensing opening or an egress 202. In the exemplary embodiment, fill opening 200 is defined within panel 22, and dispensing opening 202 is defined within panel 24. Fill opening 200 has a diameter $D_1$ with a center 204, and dispensing opening 202 has a diameter $D_2$ with a center 206. In the exemplary embodiment, diameters $D_1$ and $D_2$ are substantially equal. Alternatively, blank 10 may have any suitable number of fill openings and dispensing openings. Furthermore, in an alternative embodiment, fill opening 200 and dispensing opening 202 has any suitable shape and/or size that enables container 300 to function as described herein. Moreover, in an alternative embodiment, fill opening 200 and dispensing opening 202 may be defined within any panel and/or flap of blank 10.

Fill opening center 204 is defined a width $W_8$ from fold line 30, a width $W_9$ from fold line 32, a length $L_4$ from fold line 48, and a length $L_5$ from fold line 88. In the exemplary embodiment, width $W_8$ is substantially less than width $W_9$, and length $L_4$ is substantially less than length $L_5$. Similarly, dispensing opening center 206 is defined a width $W_{10}$ from fold line 32, a width $W_{11}$ from fold line 34, a length $L_6$ from fold line 50, and a length $L_7$ from fold line 90. In the exemplary embodiment, widths $W_{10}$ and $W_{11}$ are substantially equal, and length $L_6$ is substantially less than $L_7$. In the exemplary embodiment, lengths $L_4$ and $L_6$ are substantially equal, and lengths $L_5$ and $L_7$ are substantially equal. Alternatively, fill opening center 204 and dispensing opening center 206 are defined anywhere within panels 22 and 24, respectively.

Each fill opening 200 has a ring 208 defined within blank 10 along the periphery of fill opening 200, and dispensing opening 202 has a ring 210 defined within blank 10 along the periphery of dispensing opening 202. Rings 208 and 210 strengthen fill opening 200 and dispensing opening 202, respectively. Moreover, ring 208 has an inner diameter $D_3$ and an outer diameter $D_4$ that is greater than inner diameter $D_3$, and ring 210 has an inner diameter $D_5$ and an outer diameter $D_6$ that is greater than inner diameter $D_5$. In the exemplary embodiment, inner diameters $D_3$ and $D_5$ are substantially equal, and outer diameters $D_4$ and $D_6$ are substantially equal. Furthermore, in the exemplary embodiment, fill opening diameter $D_1$ and ring inner diameter $D_3$ are substantially equal, and dispensing opening diameter $D_2$ and ring inner diameter $D_5$ are substantially equal. A plurality of slots 216 are defined within ring 208 and extend from fill opening ring inner diameter $D_3$ to fill opening ring outer diameter $D_4$, and a plurality of slots 217 are defined within ring 210 and extend from fill opening ring inner diameter $D_5$ to fill opening ring outer diameter $D_7$. In an alternative embodiment, rings 208 and 210 have a suitable shape and/or size that enables container 300 to function as described herein. In an alternative embodiment, the shape of rings 208 and 210 coincide with the shape of fill opening 200 and dispensing opening 202, respectively.

In the exemplary embodiment, blank 10 is configured to construct outer box 250. Bag 230 is coupled within box 250 to retain a product (not shown) such as, but not limited to, a liquid. Bag 230 is fabricated from a flexible liquid-impermeable material and includes a first opening (not shown) and a second opening (not shown). Bag 230 includes an interior surface 232 that facilitates forming an internal or interior cavity and an exterior surface 234. Alternatively, bag 230 is fabricated from any material that enables container 300 to function as described herein. Bag 230 may include an insulated liner to insulate the liquid. Moreover, bag 230 is sized such that bag 230 may be enclosed within constructed container 300.

In the exemplary embodiment, a filling fixture 218 and a dispensing fixture 220 are coupled to bag 230. Filling fixtures 218 and 220 are inserted through openings 200 and 202, respectively, such that fixtures 218 and 220 are coupled to box 250. Specifically, fixtures 218 and 220 are configured to engage a portion of rings 208 and 210, respectively. Each fixture 218 and 220 is configured to be inserted through openings 200 and 202, respectively, such that each fixture 218 and 220 is inserted from interior surface 16 to exterior surface 18. Moreover, each fixture 218 and 220 may include a plurality of helical threads configured to facilitate coupling fixtures 218 and 220 to box 250. Fixtures 218 and 220 are fabricated from plastic and are configured to withstand extreme temperatures. In an alternative embodiment, each fixture 218 and 220 is fabricated from any material such as, but not limited to, a polytetrafluoroethylene material, a metallic material, a polystyrene thermal insulation material, a paper material, a plastic material, and/or any combination thereof. Moreover, in the exemplary embodiment, each fixture 218 and 220 has an opening 223 defined therein. In the exemplary embodiment, the shape of each fixture 218 and 220 coincides with the shape of fill opening 200 and dispensing opening 202, respectively. Alternatively, fixtures 218 and 220 may have any suitable shape, size, and/or construction that enables container 300 to function as described herein.

In the exemplary embodiment, each fixture 218 and 220 includes a lip 222 that is configured to couple to exterior surface 18 of blank 10. Alternatively, each lip 222 may be configured to couple to interior surface 16 of blank 10. Lip 222 acts a funnel and eases the pouring of liquid into bag 230. Moreover, lip 222 prevents each fixture 218 and 220 from being pulled back through openings 200 and 202, respectively, once lip 222 is coupled to exterior surface 18 of blank 10. Lip 222 is configured to engage a cover or cap 228. Cover 228 is coupled to lip 222 to seal constructed container 300 and prevent liquid from exiting container 300. Cover 228 may include a plurality of helical threads (not shown) configured to engage lip 222.

In the exemplary embodiment, filling fixture 218 is configured to couple to a portion of exterior surface 18 of box 250, and dispensing fixture 220 is configured to couple to a portion of exterior surface 18 of box 250. In an alternative embodiment, filling fixture 218 is configured to couple to a portion of interior surface 16 of box 250, and dispensing fixture 220 is configured to couple to a portion of interior surface 16 of box 250. In a further alternative embodiment, filling fixture 218 is configured to couple to a portion of both interior surface 16 and exterior surface 18 of box 250, and dispensing fixture 220 is configured to couple to a portion of both interior surface 16 and exterior surface 18 of box 250.

Moreover, filling fixture 218 is configured to couple to the first opening of bag 230 such that fixture 218 extends through fill opening 200 defining a first fluid passageway between the outside of box 250 and the internal cavity of bag 230. Fixture 218 is sized and shaped such that a liquid can be poured through fixture 218 from a source having an outlet spaced above fixture 218. Similarly, dispensing fixture 220 is configured to couple to the second opening of bag 230 such that fixture 220 extends through dispensing opening 202 defining a second fluid passageway between the outside of box 250 and the internal cavity of bag 230. Fixture 220 is sized and shaped such that a liquid can be poured through the dispensing fixture into a receptacle.

In the exemplary embodiment, each portion of container 300, such as blank 10, fixtures 218 and 220, and bag 230, is fabricated from a microwaveable material. A microwaveable material is a material that will withstand microwave radiation without adversely affecting the material and/or any product positioned on or near the material.

Figure 2:
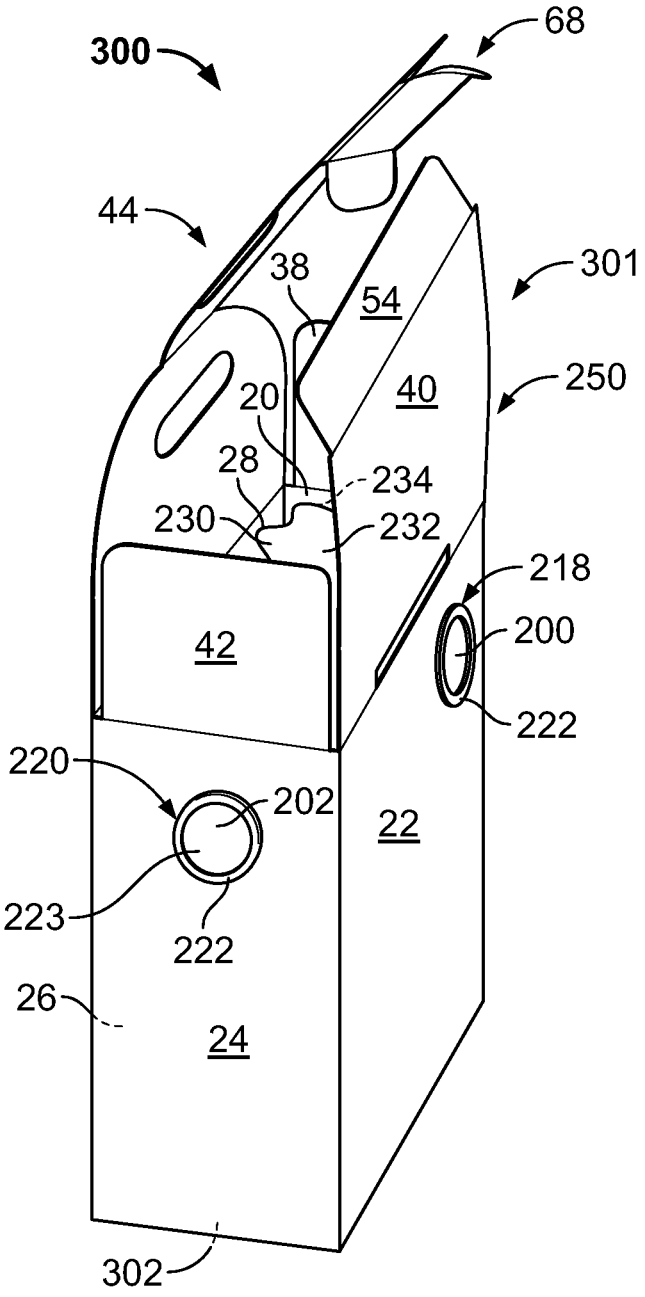
FIG. 2 is a perspective view of a container in an open configuration constructed from the blank shown in FIG. 1.
Figure 3:
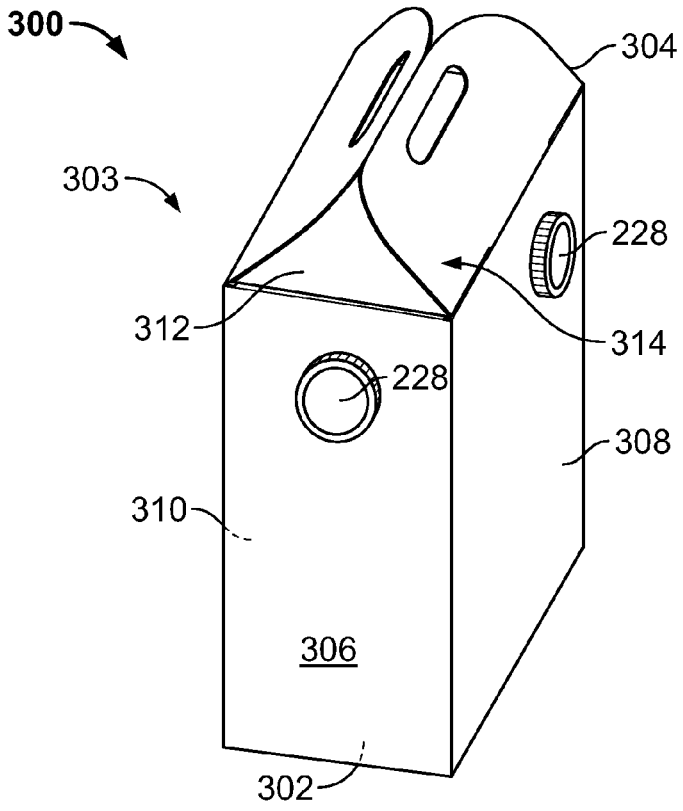
FIG. 3 is a perspective view of a container in a closed configuration constructed from the blank shown in FIG. 1.
Figure 4:
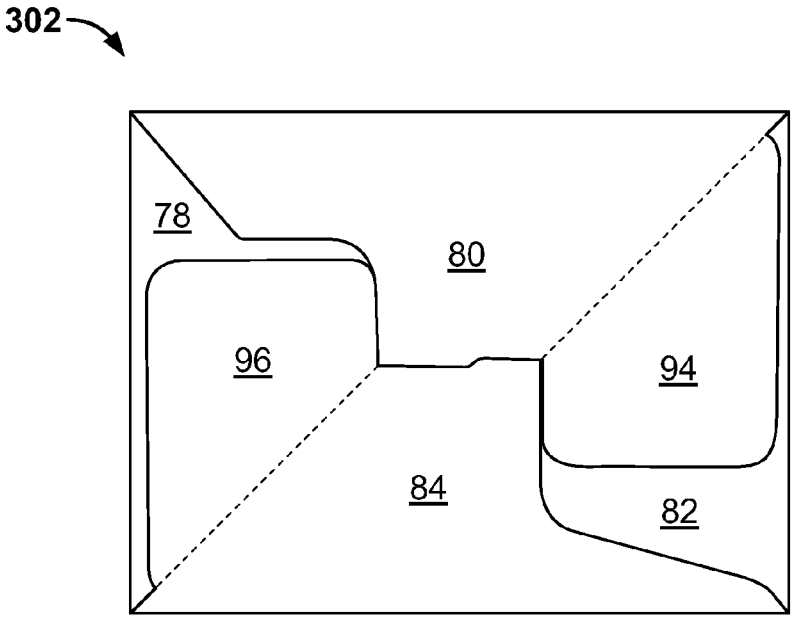
FIG. 4 is a bottom view of the container shown in FIG. 3.

FIG. 2 is a perspective view of container 300 in an open configuration 301 constructed from blank 10, and FIG. 3 is a perspective view of a container in a closed configuration 303 constructed from blank 10. FIG. 4 is a bottom view of container 300 in closed configuration 303.

During assembly of container 300, outer box 250 is formed and bag 230 is coupled within box 250, as will be described in more detail below. To form outer box 250, panels 78, 80, 82, 84, 94, and 96 form a bottom wall 302. Panels 78, 82 are folded along fold lines 86, 90, respectively, towards interior surface 16 of blank 10, panels 80, 84 are folded along fold lines 88, 92, respectively, towards interior surface 16, and flaps 94, 96 are folded along fold lines 98, 100, respectively, towards interior surface 16. Panels 80, 84 and flaps 94, 96 are coupled to panels 78, 82, respectively.

To further form box 250, panels 20, 22, 24, 26, 28 are folded along fold lines 30, 32, 34, 36 towards interior surface 16, and exterior surface 18 of panel 28 is adhesively coupled to interior surface 16 of panel 20. Each end panel 20, 24 forms a respective end wall 304, 306, and each side panel 22, 26 forms a respective side wall 308, 310. In an alternative embodiment, panel 28 is coupled to exterior surface of panel 20. Alternatively, panel 28 is coupled to panel 20 using any suitable coupling means that enables box 250 to be constructed, as described herein.

In the exemplary embodiment, fixtures 218 and 220 are coupled to bag 230. Fixture 218 is then coupled to a portion of box 250 such that fixture 218 is inserted from interior surface 16 of box 250 towards exterior surface 18 of box 150. Once fixture 218 is inserted through opening 200, a portion of fixture 218 engages ring 208 and lip 222 at least partially engages exterior surface 18 of box 250. Similarly, once fixture 220 is coupled to bag 230, dispensing fixture 220 is coupled to a portion of box 250 such that fixture 220 is inserted from interior surface 16 of box 250 towards exterior surface 18 of box 250. Once fixture 220 is inserted through opening 202, a portion of fixture 220 engages ring 210 and lip 222 at least partially engages exterior surface 18 of box 250. In an alternative embodiment, filling fixtures 218 and 220 are inserted from exterior surface 18 of box 250 towards interior surface 16 of box 250.

Moreover, filling fixture 218 is coupled to the first opening of bag 230 such that fixture 218 extends through fill opening 200 defining the first fluid passageway between the outside of box 250 and the internal cavity of bag 230. Fixture 218 enables liquid to be poured through fixture 218 from a source having an outlet spaced above fixture 218. Similarly, dispensing fixture 220 is coupled to the second opening of bag 230 such that fixture 220 extends through dispensing opening 202 defining the second fluid passageway between the outside of box 250 and the internal cavity of bag 230. Fixture 220 enables liquid to be poured through the dispensing fixture into a receptacle. In one embodiment, bag 230 is coupled within box 250 such that bag 230 does not contact the walls of container 300 preventing heat loss through the walls of container 300.

After forming container walls 302, 306, 308, 310, a top wall 312 is formed by panel 40. Specifically, panels 38, 42 are folded along fold lines 46, 50, respectively, towards interior surface 16, and panel 40 is folded along fold line 48 towards interior surface 16. Flap 54 is folded along fold line 56 towards interior surface 16. Interior surface 16 of panel 40 is substantially adjacent at least a portion of exterior surface 18 of panels 38, 42, and exterior surface 18 of flap 54 is substantially adjacent interior surface 16 of panel 26. In one embodiment, flap 54 is adhesively coupled to interior surface 16 of panel 26.

After bag 230 is coupled and/or stored within container 300 and top wall 312 is formed, panel 44 forms a handle 314. Specifically, flaps 58 and 60 are folded along fold line 62 towards interior surface 16. Handle flap first and third portions 72 and 76 are folded along fold lines 118 and 120 towards second portion 74. In the exemplary embodiment, portions 72 and 76 are positioned substantially planar with second portion 74, and is inserted into slot 49. Once handle flap 68 is inserted into slot 49, portions 72 and 76 engage a portion of top wall 312 to securely coupling handle 314 within box 250. A user (not shown) may transport and/or carry container 300 using handle 314 and handle openings 64 and 66.

During use, bag 230 of container 300 is filled with a liquid, such as coffee. In the exemplary embodiment, cover 228 is coupled to lip 222 of fixture 220. Liquid is poured into fill opening 200 such that the liquid flows through the first fluid passageway and fixture 218 into the internal cavity of bag 230. As the liquid is poured bag 230 of container 300, fixture lip 222 facilitates funneling the liquid into bag 230 to prevent the liquid from splashing onto the user and/or container 300. A liquid may be poured directly into bag 230 from a source such as a variety of dispensers, such as a spigot or an urn type dispenser. The source outlet is spaced above filling fixture 218 while filling bag 230. To fill bag 230, container 300 does not need to be tilted, as tilting the container can make the transfer of hot liquids dangerous. Rather, container 300 may be positioned such that side wall 310 of container 300 is substantially flush with a surface (i.e., a countertop, a table, etc). By positioning container 300 on side wall 310, fill opening 200 may be aligned with a spout of a liquid dispenser. Because container 300 can be filled while on its side, container 300 may be used in situations when space limitations are at issue.

Once the liquid is stored within bag 230, cover 228 is coupled to lip 222 to prevent the liquid from exiting bag 230 and/or container 300 through fill opening 200. In the exemplary embodiment, to remove and/or dispense the liquid from bag 230, the liquid is poured from the internal cavity of bag 230 through the second fluid passageway and fixture 220 into a receptacle such as a coffee mug.

Figure 5:
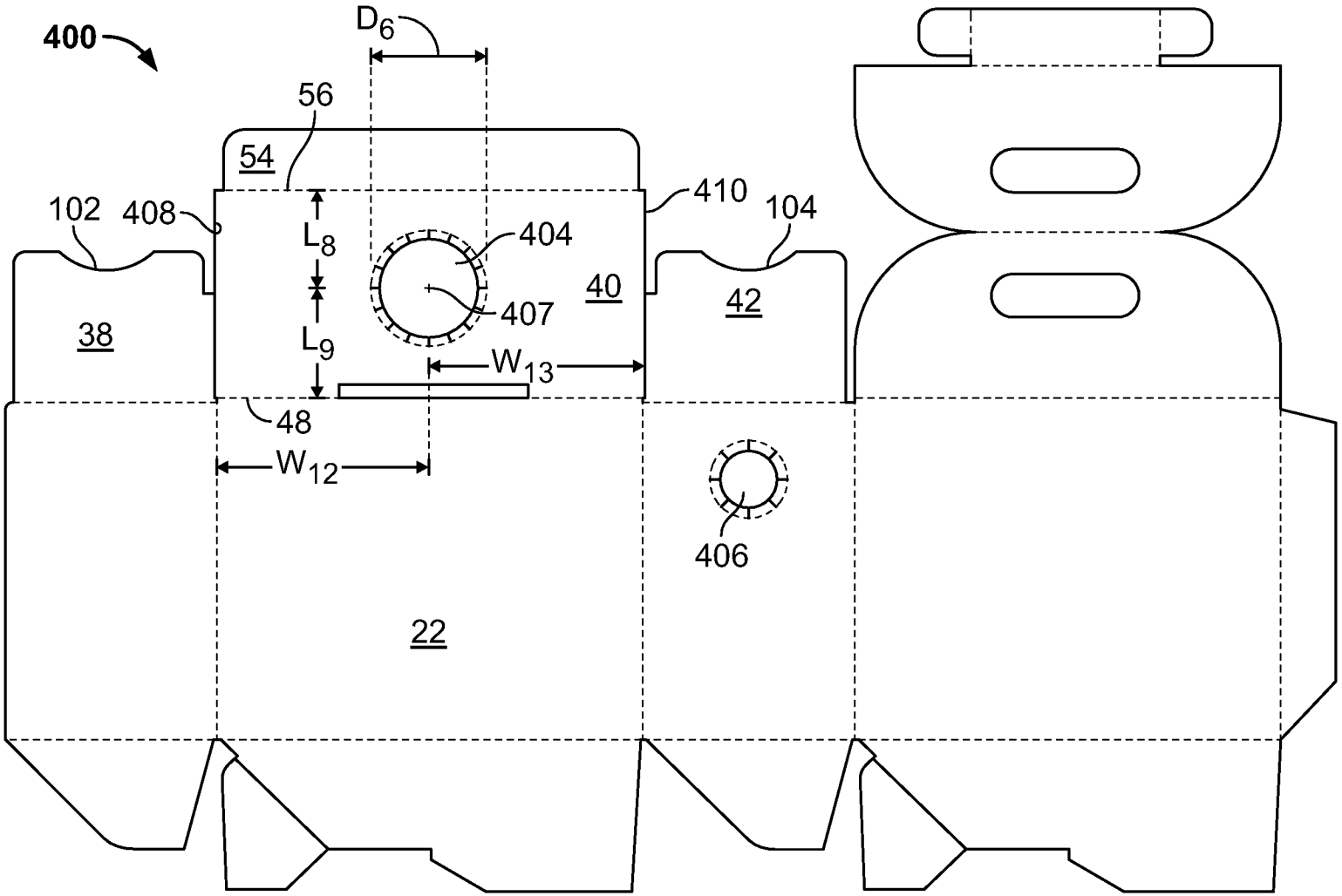
FIG. 5 is a top plan view of a blank of sheet material for constructing a container according to a first alternative embodiment.
Figure 8:
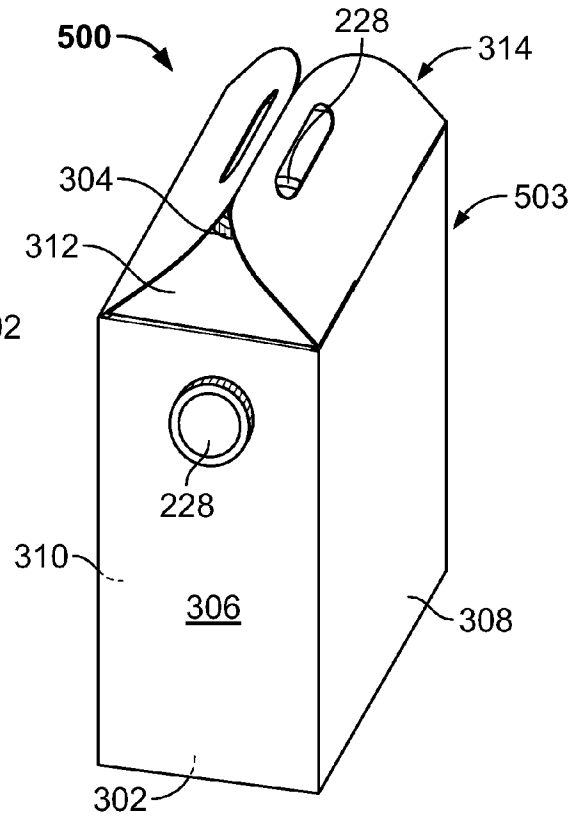
FIG. 8 is a perspective view of a container in a closed configuration constructed from the blank shown in FIG. 5.
Figure 7:
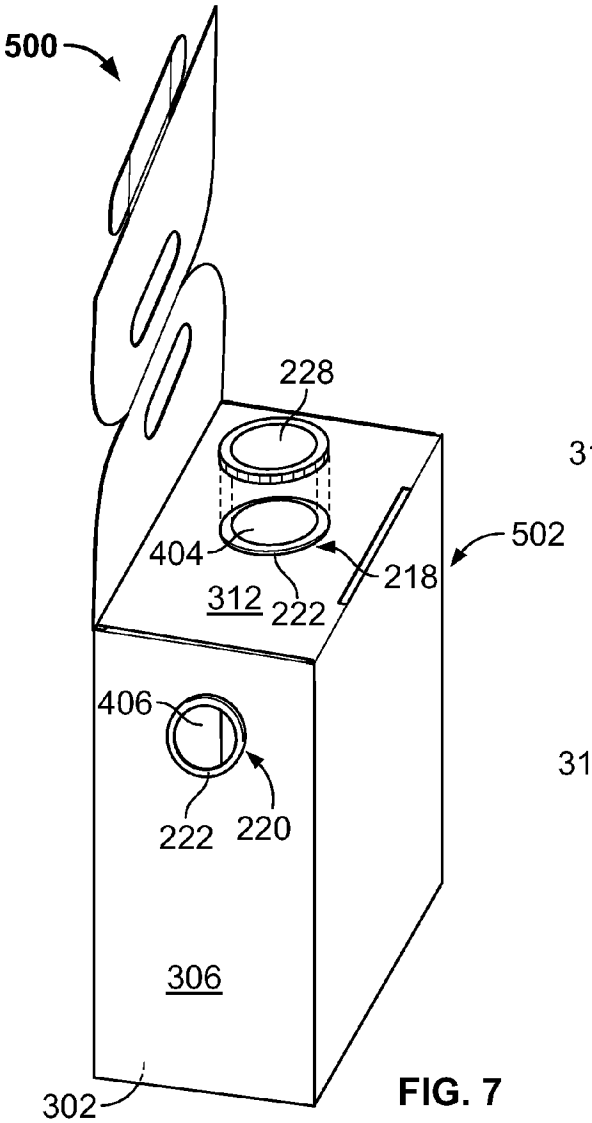
FIG. 7 is a perspective view of a container in a fill configuration constructed from the blank shown in FIG. 5.
Figure 6:
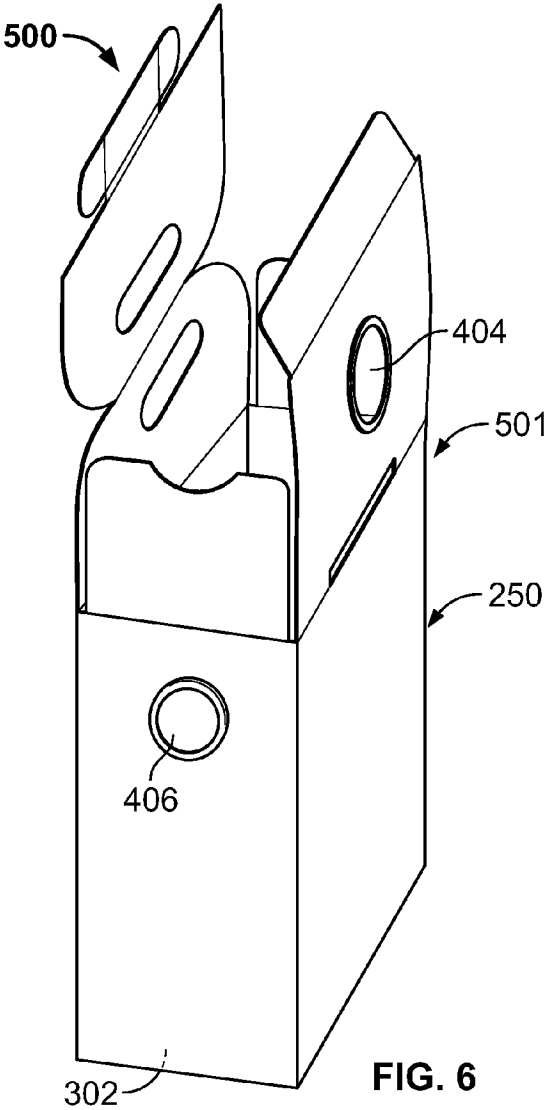
FIG. 6 is a perspective view of a container in an open configuration constructed from the blank shown in FIG. 5.

FIG. 5 is a top plan view of a blank of sheet material 400 for constructing a container 500. FIG. 6 is a perspective view of container 500 in an open configuration 501 constructed from blank 400. FIG. 7 is a perspective view of container 500 in a fill configuration 502 constructed from blank 400. FIG. 8 is a perspective view of container 500 in a closed configuration 503 constructed from blank 400.

Generally, blank 400 and container 500 are similar to blank 10 and container 300, respectively, and like components are identified with like reference numerals. As shown in FIG. 5, blank 400 includes at least one fill opening 404 and dispensing opening 406.

Fill opening 404 is similar to fill opening 200 and like components are identified with like reference numerals. Similarly, dispensing opening 406 is similar to dispensing opening 202 and like components are identified with like reference numerals. However, in contrast to fill opening 200, fill opening 404 is defined within panel 40 and has a center 407. Specifically, fill opening center 407 is defined a width $W_{12}$ from a first side edge 408 of panel 40, a width $W_{13}$ from a second side edge 410 of panel 40, a length $L_8$ from fold line 56, and a length $L_9$ from fold line 48. In an alternative embodiment, width $W_{12}$ is substantially equal to width $W_{13}$, and length $L_8$ is substantially equal to length $L_9$. In an alternative embodiment, fill opening 404 and dispensing opening 406 may be positioned anywhere within panels 40 and 24, respectively. Fill opening 404 has a diameter $D_8$, and dispensing opening 406 has a diameter $D_1$. Diameter $D_8$ is greater than diameter $D_1$. In an alternative embodiment, openings 404 and 406 may have any shape and/or size that facilitates enabling container 500 to function as described herein.

Moreover, in contrast to edges 102 and 104 of panels 38 and 42 shown in FIG. 1, edges 102 and 104 of panels 38 and 42 are substantially curvilinear, as shown in FIG. 5, to prevent panels 38, 42 from interfering with fill opening 404.

In contrast to the construction of container 300, handle 314 of container 500 is formed after bag 230 has been filled with the product.

In contrast to use of container 300, bag 230 of container 500 is filled with a liquid such as coffee. In the exemplary embodiment, cover 228 is coupled to dispensing fixture 220 to prevent the product from exiting bag 230 and/or container 500, and bottom wall 302 of container 500 is positioned substantially flush with a surface (i.e., a countertop, a table, etc) while bag 230 is being filled. Liquid is poured from a source outlet into fill opening 404 such that the liquid flows through the first fluid passageway and fixture 218 into the internal cavity of bag 230.

Once bag 230 is filled with the product, a fill opening cover 228 is coupled to filling fixture 218. To remove the product from bag 230, dispensing opening cover 228 is removed from fixture 220 and the liquid is poured from the internal cavity of bag 230 through the second fluid passageway and fixture 220 into a receptacle such as a coffee mug.

Figure 9:
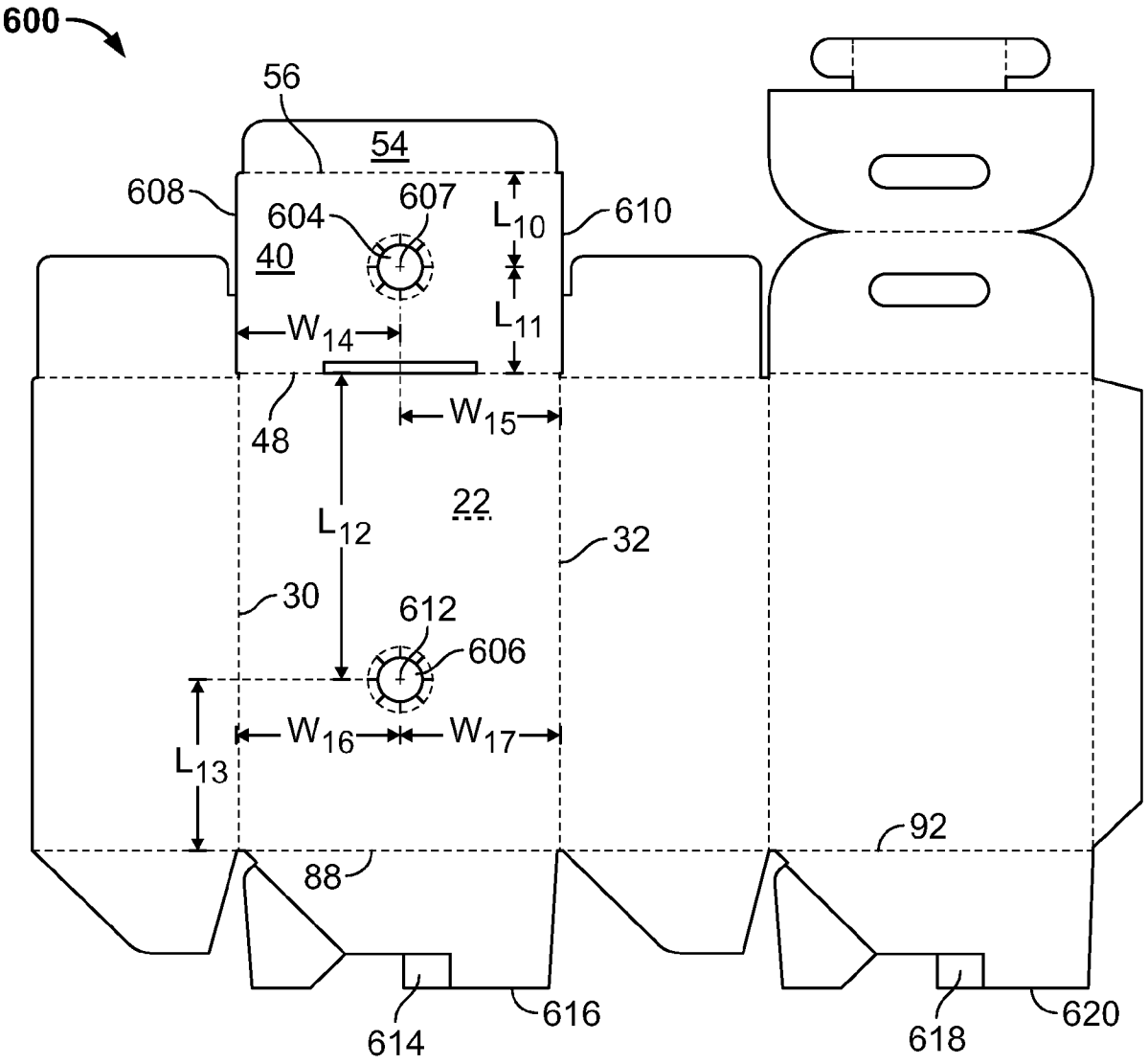
FIG. 9 is a top plan view of a blank of sheet material for constructing a container according to a second alternative embodiment.
Figure 10:
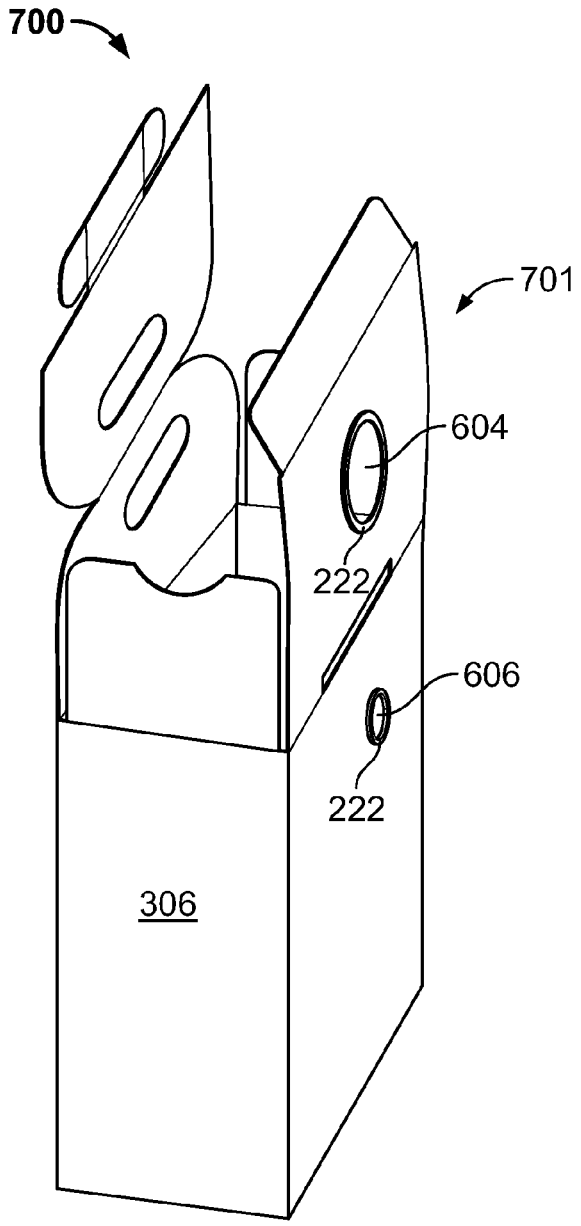
FIG. 10 is a perspective view of a container in an open configuration constructed from the blank shown in FIG. 9.
Figure 11:
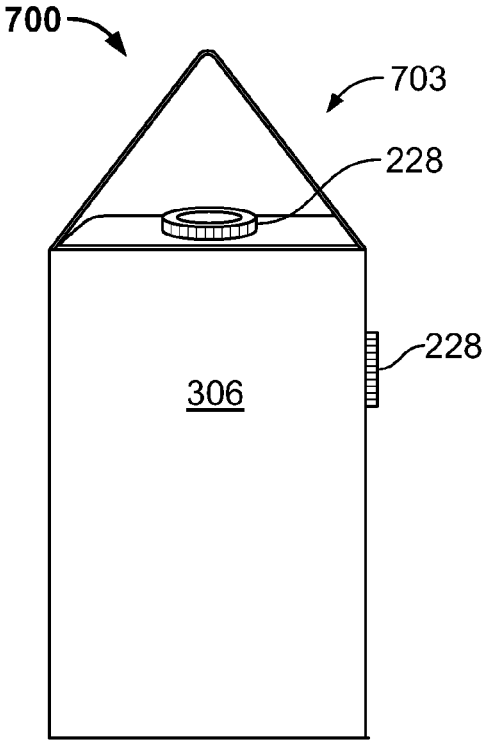
FIG. 11 is a perspective view of a container in a closed configuration constructed from the blank shown in FIG. 9.

FIG. 9 is a top plan view of a blank of sheet material 600 for constructing a container 700. FIG. 10 is a perspective view of container 700 in an open configuration 701 constructed from blank 600. FIG. 11 is a perspective view of container 700 in a closed configuration 703 constructed from blank 600.

Generally, blank 600 and container 700 are similar to blank 10 and container 300, respectively, and like components are identified with like reference numerals. As shown in FIG. 9, blank 600 includes at least one fill opening 604 and dispensing opening 606.

Fill opening 604 is similar to fill opening 200 and like components are identified with like reference numerals. However, in contrast to fill opening 200, fill opening 604 is defined within panel 40 and has a center 607. Fill opening center 607 is defined a width $W_{14}$ from a first side edge 608 of panel 40, a width $W_{15}$ from a second side edge 610 of panel 40, a length $L_{10}$ from fold line 56, and a length $L_{11}$ from fold line 48. In this embodiment, width $W_{14}$ is substantially equal to width $W_{15}$, and length $L_{10}$ is substantially equal to length $L_{11}$.

Similarly, dispensing opening 606 is similar to dispensing opening 202 and like components are identified with like reference numerals. However, in contrast to dispensing opening 202, dispensing opening 606 is defined within panel 22 and has a center 612. Specifically, dispensing opening center 612 is defined a width $W_{16}$ from fold line 30 of panel 22, a width $W_{17}$ from fold line 32 of panel 22, a length $L_{12}$ from fold line 48, and a length $L_{13}$ from fold line 88. In this embodiment, width $W_{16}$ is substantially equal to width $W_{17}$, and length $L_{12}$ is greater than length $L_{13}$. Width $W_{16}$ is substantially equal to width $W_{14}$, and width $W_{17}$ is substantially equal to width $W_{15}$. In this embodiment, fill opening 604 and dispensing opening 606 may be positioned anywhere within panels 40 and 22, respectively.

In the exemplary embodiment, fill opening 404, and dispensing opening 406 each have a diameter $D_1$. In an alternative embodiment, fill opening 604 and dispensing opening 606 may be positioned anywhere within panels 40 and 22, respectively. In an alternative embodiment, openings 604 and 606 may have any shape and/or size that enables container 500 to function as described herein.

In contrast to panels 80 and 84 shown in FIG. 1, panel 80 shown in FIG. 5 includes a flap 614 extending from an edge 616 distal from fold line 88, and panel 84 includes a flap 618 extending from an edge 620 distal from fold line 92. Flaps 614 and 618 ease assembly of bottom wall 302 and facilitate keeping bottom wall 302 erect by locking panels of bottom wall 302 together.

In contrast to the construction of container 300, handle 314 of container 700 is formed after bag 230 has been filled with the product.

Moreover, in contrast to use of container 300, bag 230 of container 700 is filled with the product. In the exemplary embodiment, dispensing opening cover 228 is coupled to fixture 220 to prevent the product from exiting bag 230 and/or container 700, and bottom wall 302 of container 700 is positioned substantially flush with a surface (i.e., a countertop, a table, etc) while bag 230 is being filled. Liquid is poured from a source outlet into fill opening 604 such that the liquid flows through the first passageway and fixture 218 into the internal cavity of bag 230.

Once bag 230 is filled with the product, fill opening cover 228 is coupled to filling fixture 218. To remove the product from bag 230, cover 228 is removed from fixture 220 and the liquid is poured from the internal cavity of bag 230 through the second fluid passageway and fixture 220 into a receptacle such as a coffee mug.

The above-described container includes an outer box formed from a unitary blank having a fill opening and a dispensing opening and a flexible liquid-impermeable bag coupled and/or stored within the outer box. The container enables a user to fill the container with a liquid, such as coffee, through the filing fixture extending through the fill opening, and enables a user to dispense the liquid from the container through the dispensing fixture extending through the dispensing opening. As described above, the fill opening enables a user to pour liquid directly from a spigot, an urn type dispenser, or coffee pot directly into the container by positioning the dispenser a distance from the fill opening. As such, the container is filled without tilting the container.

Moreover, the filling and dispensing fixtures are coupled to first and second openings, respectively, defined within the bag, and define a first and second fluid passageway extending between the outside of the box and an internal cavity of the bag. The filling fixtures are shaped to prevent the liquid from splashing onto a user or onto the container. Also, the filling fixtures are fabricated to withstand extreme temperatures. As such, the above-described container enables a user to pour liquid into the container with ease. The above-described container is filled without the use of additional devices.

Furthermore, the above-described container is microwavable and easily assembled. The container also includes an integrally-formed handle. The handle is formed from at least one panel and a portion of the panel is insertable into a slot defined within the container. When a portion of the panel is inserted into the slot, a handle is formed. A user may use the handle to easily transport and/or carry the container.

While the invention has been described in terms of various specific embodiments, those skilled in the art will recognize that the invention can be practiced with modification within the spirit and scope of the claims.

What is claimed is:

1. A bag-in-box container for storing and dispensing liquids, said container comprising:

an outer box comprising two opposing end walls, two opposing side walls, a bottom wall, a top wall, a handle, a fill opening, and a dispensing opening, wherein said handle comprises a first handle flap extending from a top edge of a first side wall of said two opposing side walls and a second handle flap extending from a top edge of said first handle flap, said second handle flap removably coupled to said outer box proximate to a top edge of a second side wall of said two opposing side walls, said handle extending over said top wall from approximately said first side wall top edge to approximately said second side wall top edge, wherein said top wall further comprises a slot defined therein proximate to said second side wall, wherein said second handle flap is configured to be inserted into said slot such that said first handle flap and said second handle flap form said handle for carrying said container; and an inner, liquid-impermeable bag stored within said outer box, said bag comprising a first opening, a filling fixture coupled to said first opening, a second opening, and a dispensing fixture coupled to said second opening, said filling fixture extending through said fill opening and defining a first fluid passageway extending from outside of said box to an internal cavity of said bag, said dispensing fixture extending through said dispensing opening and defining a second fluid passageway from the bag internal cavity to outside of said box.

2. A container in accordance with claim 1 wherein said fill opening is defined within at least one of said two opposing side walls and said top wall, and wherein said dispensing opening is defined within at least one of said two opposing end walls and said two opposing side walls.

3. A container in accordance with claim 1 wherein said fill opening is defined within at least one of said two opposing side walls, and wherein said dispensing opening is defined within at least one of said at least two opposing end walls.

4. A container in accordance with claim 1 wherein said fill opening comprises an aperture defined within said top wall, and wherein said dispensing opening is defined within at least one of said end walls, said fill opening positioned beneath said handle, wherein said handle is partially removable from a location proximate to said second side wall top edge to provide access to said fill opening.

5. A container in accordance with claim 1 wherein said fill opening is defined within said top wall, and wherein said dispensing opening is defined within at least one of said side walls, said fill opening positioned beneath said handle.

6. A container in accordance with claim 1 wherein said first handle flap and said second handle flap each comprise a handle opening such that said container is configured to be carried by said handle openings.

7. A container in accordance with claim 1 wherein said filling fixture has a first diameter and said dispensing fixture has a second diameter, the first diameter is one of substantially equal to the second diameter and greater than the second diameter.

8. A container in accordance with claim 1 wherein at least one of said filling fixture and said dispensing fixture is coupled to a portion of one of an interior surface of said box and an exterior surface of said box.

9. A container in accordance with claim 1 wherein said filling fixture is coupled to said box on both an internal surface of said box and an external surface of said box, and wherein said dispensing fixture is coupled to said box on both the internal surface of said box and the external surface of said box.

10. A container in accordance with claim 1 wherein at least one of said filling fixture and said dispensing fixture includes a threaded lip configured to threadably engage a cap, said lip is configured to funnel the liquid through at least one of said first fluid passageway and said second fluid passageway, said cap is configured to retain the liquid within said bag.

11. A container in accordance with claim 1, wherein said bottom wall is formed from a plurality of bottom panels, each bottom panel of the plurality of bottom panels extending from one panel of one of said two end walls and said two side walls.

12. A container in accordance with claim 1, wherein said first handle flap is oriented at a first angle to said first side wall, said second handle flap is oriented at a second angle to said second side wall, and said first handle flap and said second handle flap are oriented at a third angle to each other.

13. A container in accordance with claim 1, wherein said top wall comprises a top panel extending substantially parallel to said bottom wall from said second side wall top edge to said first side wall top edge, said top panel connected to said second side wall top edge and coupled adjacent to said first side wall top edge.

14. A bag-in-box container for storing and dispensing liquids, said container comprising:

an outer box formed from a blank comprising two opposing end panels, two opposing side panels, a plurality of bottom panels, a top panel, a first handle panel, a second handle panel, a fill opening, and a dispensing opening, said first handle panel extending from a top edge of a first side panel of said two opposing side panels and said second handle panel extending from a top edge of said first handle panel, said second handle panel removably coupled to said outer box proximate to a top edge of a second side panel of said two opposing side panels, said first handle panel and said second handle panel forming a handle that extends over said top panel from approximately said first side panel top edge to approximately said second side panel top edge, wherein said top panel further comprises a slot defined therein proximate to said second side panel, wherein said second handle panel is configured to be inserted into said slot such that said first handle panel and said second handle panel form said handle for carrying said container; and an inner, liquid-impermeable bag stored within said outer box, said bag comprising a first opening, a filling fixture coupled to said first opening, a second opening, and a dispensing fixture coupled to said second opening, wherein said fill opening is configured to receive said filling fixture, said dispensing opening is configured to receive said dispensing fixture, said filling fixture defining a first fluid passageway and sized and shaped such that a liquid can be poured through said filling fixture from a source having an outlet spaced above said filling fixture, and said dispensing fixture defining a second fluid passageway and sized and shaped such that the liquid can be poured through said dispensing fixture into a receptacle.

15. A container in accordance with claim 14 wherein said fill opening is defined within at least one of said two opposing side panels and said top panel, and wherein said dispensing opening is defined within at least one of said two opposing end panels and said two opposing side panels.

16. A method of constructing a bag-in-box container for storing and dispensing liquids, said method comprising:

forming an outer box comprising two opposing end walls, two opposing side walls, a bottom wall, a top wall, a handle, a fill opening, and a dispensing opening, wherein the handle comprises a first handle flap extending from a top edge of a first side wall of the two opposing side walls and a second handle flap extending from a top edge of the first handle flap, the second handle flap removably coupled to the outer box proximate to a top edge of a second side wall of the two opposing side walls, the handle extending over the top wall from approximately the first side wall top edge to approximately the second side wall top edge;

defining the fill opening as an aperture within the top wall, and defining the dispensing opening as an aperture within at least one of the first side wall, the second side wall, a first end wall of the two opposing end walls, and a second end wall of the two opposing end walls; and coupling an inner, liquid-impermeable bag within the outer box to store the bag within the outer box, the bag comprising a first opening, a filling fixture coupled to the first opening, a second opening, and a dispensing fixture coupled to the second opening, the filling fixture extending through the fill opening and defining a first fluid passageway extending from outside of the box to an internal cavity of the bag, the dispensing fixture extending through the dispensing opening and defining a second fluid passageway extending from the bag internal cavity to the outside of the box.

17. A method in accordance with claim 16 further comprising positioning the fill opening of the container beneath a source having an outlet spaced above the filling fixture, wherein a liquid is poured from the source into the container though the filling fixture.

18. A method in accordance with claim 16 further comprising positioning the dispensing opening of the container above a receptacle, wherein a liquid is poured through the dispensing fixture into the receptacle.

19. A method in accordance with claim 16 wherein the outer box further comprises a slot defined therein proximate the second side wall top edge, said method further comprising inserting a portion of the second handle flap into the slot to form the handle.

20. A bag-in-box container for storing and dispensing liquids, said container comprising:

an outer box comprising two opposing end walls, two opposing side walls, a bottom wall, a top wall, a handle, a fill opening, and a dispensing opening, wherein said handle comprises a first handle flap extending from a top edge of a first side wall of said two opposing side walls and a second handle flap extending from a top edge of said first handle flap, said second handle flap removably coupled to said outer box proximate to a top edge of a second side wall of said two opposing side walls, said handle extending over said top wall from approximately said first side wall top edge to approximately said second side wall top edge, wherein said fill opening comprises an aperture defined within said top wall, wherein said dispensing opening is defined within at least one of said end walls, wherein said fill opening is positioned beneath said handle, and wherein said handle is partially removable from a location proximate to said second side wall top edge to provide access to said fill opening; and an inner, liquid-impermeable bag stored within said outer box, said bag comprising a first opening, a filling fixture coupled to said first opening, a second opening, and a dispensing fixture coupled to said second opening, said filling fixture extending through said fill opening and defining a first fluid passageway extending from outside of said box to an internal cavity of said bag, said dispensing fixture extending through said dispensing opening and defining a second fluid passageway from the bag internal cavity to outside of said box.

21. A bag-in-box container for storing and dispensing liquids, said container comprising:

an outer box comprising two opposing end walls, two opposing side walls, a bottom wall, a top wall, a handle, a fill opening, and a dispensing opening, wherein said handle comprises a first handle flap extending from a top edge of a first side wall of said two opposing side walls and a second handle flap extending from a top edge of said first handle flap, said second handle flap removably coupled to said outer box proximate to a top edge of a second side wall of said two opposing side walls, said handle extending over said top wall from approximately said first side wall top edge to approximately said second side wall top edge, wherein said fill opening is defined within said top wall, and wherein said dispensing opening is defined within at least one of said side walls, said fill opening positioned beneath said handle; and an inner, liquid-impermeable bag stored within said outer box, said bag comprising a first opening, a filling fixture coupled to said first opening, a second opening, and a dispensing fixture coupled to said second opening, said filling fixture extending through said fill opening and defining a first fluid passageway extending from outside of said box to an internal cavity of said bag, said dispensing fixture extending through said dispensing opening and defining a second fluid passageway from the bag internal cavity to outside of said box.

* * * * *